US008622211B2

(12) United States Patent
Zorc

(10) Patent No.: US 8,622,211 B2
(45) **Date of Patent: *Jan. 7, 2014**

(54) SYSTEM AND METHOD FOR DISPLAYING A PADLOCK

(75) Inventor: Phil Zorc, Laguna Niguel, CA (US)

(73) Assignee: Hampton Products International Corporation, Foothill Ranch, CA (US)

( * ) Notice: Subject to any disclaimer, the term of this patent is extended or adjusted under 35 U.S.C. 154(b) by 861 days.

This patent is subject to a terminal disclaimer.

(21) Appl. No.: 12/729,024

(22) Filed: Mar. 22, 2010

(65) Prior Publication Data

US 2011/0226653 A1 Sep. 22, 2011

(51) Int. Cl.
*A45C 11/26* (2006.01)

(52) U.S. Cl.
USPC ..... 206/349; 206/495

(58) Field of Classification Search
USPC ..... 206/467, 469, 470, 471, 463, 462, 464, 206/775, 776, 778, 806, 481, 461, 349, 477, 206/490, 495
See application file for complete search history.

(56) References Cited

U.S. PATENT DOCUMENTS

| | | | | |
|---|---|---|---|---|
| 791,912 | A | 6/1905 | Jackson | |
| 1,711,877 | A * | 5/1929 | Drehmann | 206/464 |
| 2,949,185 | A * | 8/1960 | Foote et al. | 206/483 |
| 3,236,372 | A | 2/1966 | Foote | |
| 3,497,059 | A | 2/1970 | Watts, Jr. | |
| 4,331,237 | A * | 5/1982 | Edell | 206/461 |
| 5,462,161 | A * | 10/1995 | Halaburda et al. | 206/705 |
| 6,840,389 | B2 * | 1/2005 | Chen | 211/70.6 |
| 7,516,843 | B2 | 4/2009 | Konop et al. | |
| 2004/0035731 | A1 * | 2/2004 | Lee | 206/349 |
| 2005/0072708 | A1 * | 4/2005 | Selby | 206/461 |

* cited by examiner

*Primary Examiner* — Jacob K Ackun
*Assistant Examiner* — Jenine Pagan
(74) *Attorney, Agent, or Firm* — O'Melveny & Myers LLP

(57) ABSTRACT

For example, a first retaining tab may have a first (curved) surface and a second surface substantially parallel to the face of the card, wherein the first surface restricts movement of the padlock in a direction parallel to the face of the card (i.e., prevents the padlock from moving side to side) and the second surface restricts movement of the padlock in a direction orthogonal to the face of the card (i.e., prevents the padlock from moving out, away from the face of the card). Once the padlock is placed in the aperture and the back plate is attached to the card, the padlock is secured (e.g., between at least one retaining tab and the back plate) and ready to be displayed (e.g., on a hook, on a shelf, on a display rack, etc.).

13 Claims, 13 Drawing Sheets

SYSTEM AND METHOD FOR DISPLAYING A PADLOCK

BACKGROUND OF THE INVENTION

1. Field of the Invention

The present invention relates to padlocks, or more particularly, to a system and method for displaying a padlock.

2. Description of Related Art

Padlocks are commonly sold in hardware and home improvement stores. A padlock is generally packaged in plastic, or what is commonly referred to as a "clam shell package." A clam shell package generally includes two pieces of clear, pre-formed plastic (e.g., a front contoured sheet and a back sheet). Once the item (e.g., a padlock) is placed between the two pieces of plastic, the plastic sheets are fused together at their edges.

One drawback of a clam shell package is that it is generally very difficult to open, often times requiring the use of either a knife or scissors. In fact, clam shell packages are so difficult to open, over 6,000 Americans per year visit the emergency room after opening (or attempting to open) a clam shell package.

Another drawback of a clam shell package is that it does not allow the consumer to touch or feel the item without first removing the item from its package. This is important because some consumers are more comfortable buying an item after they have had an opportunity to touch it. By touching the item, the consumer may be able to detect certain features, e.g., whether the item is solid or hollow, plastic or metal, sturdy or flimsy, etc. Because a clam shell package is difficult to open, a consumer generally has to buy the item, take it home and destroy the package (e.g., with a knife or scissors) in order to touch the item. If the consumer is dissatisfied with the item, the consumer then has to return the item to the store. The item is then sent back to the manufacturer, where it is inspected and repackaged. Not only does this result in a waste of time for the consumer, but it also results in a waste of time and money for the store and the manufacturer.

A potential solution would be to construct a package that can be easily opened, thereby allowing the consumer to open the package at the store. While this would allow the consumer to touch the item before buying it, it would also increase the risk of selling an item with missing pieces (e.g., missing instructions, warranties, fasteners, keys, etc.). Not only is such a situation frustrating to the consumer, but it also reflects poorly on the store and the manufacturer.

Thus, it would be advantageous to provide a system and method for packaging a padlock that overcomes at least some of the foregoing drawbacks. For example, it would be beneficial to retain a padlock in a package that would allow a consumer to touch and feel at least a portion of the padlock without having to remove the padlock from its package.

SUMMARY OF THE INVENTION

The present invention provides a system and method for displaying a padlock. Preferred embodiments of the present invention operate in accordance with a card, a back plate and/or a padlock.

In one embodiment of the present invention, the system includes a padlock, a card and a back plate, wherein the card includes a front side, a back side and an aperture sized to receive the padlock, and the back plate is configured to be attached to the back side of the card. The card further includes a plurality of retaining tabs that extend from the front and/or back side of the card and are used to retain the padlock by restricting movement of the padlock in a direction orthogonal and/or parallel to the face of the card. Each retaining tab is configured to retain (or support) the padlock by providing at least one retaining surface. For example, a first retaining tab may have a first (curved) surface and a second surface substantially parallel to the face of the card, wherein the first surface restricts movement of the padlock in a direction parallel to the face of the card (i.e., prevents the padlock from moving side to side) and the second surface restricts movement of the padlock in a direction orthogonal to the face of the card (i.e., prevents the padlock from moving out, away from the face of the card).

Once the padlock is placed in the aperture and the back plate is attached to the card, the padlock is secured (e.g., between at least one retaining tab and the back plate) and ready to be displayed. In one embodiment of the present invention, the card further includes a second aperture configured to mate with a hook on a display rack. In another embodiment of the present invention, the card further includes at least one foot (e.g., a foot extending from a front side of the card, a foot extending from a back side of the card, etc.) that is substantially tangential to (or aligned with) a bottom of the card, thereby allowing the system to be placed on a horizontal shelf and supported in a substantially vertical position.

In another embodiment of the present invention, the system includes a card and a back plate, wherein the card includes a front side, a back side and a plurality of retaining tabs and the back plate is configured to be attached to a back side of the card. As before, the retaining tabs extend from the front and/or back side of the card and are used to retain a padlock by restricting movement of the padlock in a direction orthogonal and/or parallel to the front side of the card. Each retaining tab is configured to retain (or support) the padlock by providing at least one retaining surface. For example, a first retaining tab may have a first (curved) surface and a second surface substantially parallel to the front side of the card, wherein the first surface restricts movement of the padlock in a direction parallel to the front side of the card (i.e., prevents the padlock from moving side to side) and the second surface restricts movement of the padlock in a direction orthogonal to the front side of the card (i.e., prevents the padlock from moving out, away from the front side of the card).

In accordance with this embodiment, the card further includes an aperture that is sized to receive at least a body of the padlock. This may be accomplished, for example, by (i) positioning the padlock behind the card, (ii) placing a shackle of the padlock through the aperture (e.g., from the back side of the card), (iii) moving the shackle upward, toward the front side of the card, and (iv) and moving the body of the padlock through the aperture until the body comes into contact with at least one retaining tab.

In one embodiment of the present invention, the card and back plate further include, respectively, a first set of coupling portions and a second set of coupling portions, wherein the first set of coupling portions are configured to mate with the second set of coupling portions. For example, a first coupling portion of the card may be configured to mate with a first coupling portion of the back plate, a second coupling portion of the card may be configured to mate with a second coupling portion of the back plate, etc. In one embodiment of the present invention, the first set of coupling portions include at least one coupling tab and the second set of coupling portions include at least one coupling ledge, wherein the coupling tab is configured to mate with the coupling ledge.

In another embodiment of the present invention, the back plate further includes a front side and at least one retaining surface. Like the retaining tabs, the retaining surface is used to retain the padlock by restricting movement of the padlock in a direction parallel to the front side of the card. In contradistinction, the front side of the back plate is used to retain the padlock by restricting movement of the padlock in a direction orthogonal to the front side of the card.

In another embodiment of the present invention, the back plate further includes a recess, preferably shaped to receive at least one key, and/or a post configured to mate with at least one aperture in the key(s). By placing the padlock into the aperture of the card, placing the key(s) into the recess of the back plate and/or over the post of the back plate, and attaching the back plate to the card, both the padlock and the key are secured (or retained) and ready to be displayed.

In one embodiment of the present invention, the card further includes a second aperture configured to mate with a hook on a display rack. By placing the second aperture over the hook, the card can be supported in a substantially vertical position. In another embodiment of the present invention, the card further includes at least one foot that is substantially tangential to (or aligned with) a bottom of the card, thereby allowing the system to be placed on a horizontal shelf (or surface) and supported in a substantially vertical position.

In the foregoing embodiments, by limiting the size and/or number of retaining tabs, the consumer can freely touch portions of the padlock (e.g., portions of the body, the shackle, etc.) without having to remove the padlock from its package (e.g., the card and the back plate).

In accordance with one embodiment of the present invention, a method for displaying a padlock includes placing at least a body of a padlock through an aperture in a card. In one embodiment, this is accomplished by (i) placing the shackle of the padlock through the aperture (e.g., from a back side of the card), (ii) rotating the shackle upward (e.g., toward a front side of the card), and (iii) placing the body of the padlock inside the aperture of the card. If the padlock includes a key, then the key is placed inside a back plate (e.g., inside a recess in the back plate, over a post on the back plate, etc.). The back plate is then attached to the card by mating a first set of coupling portions on the card (e.g., coupling tabs) with a second set of coupling portions on the back plate (e.g., coupling apertures). This results in the padlock body being retained between the card (e.g., a retaining tab portion of the card) and the back plate. It also results in the key being retained between the padlock body and the back plate (e.g., a front side of the back plate, a recess in the back plate, etc.). The package can then be placed on either a hook (e.g., via an aperture in the card) or on a shelf (e.g., via a front foot and/or a rear foot).

A more complete understanding of a system and method for displaying a padlock will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF THE PREFERRED EMBODIMENT

The present invention provides a system and method for displaying a padlock. In the detailed description that follows, like element numerals are used to describe like elements illustrated in one or more figures.

Figure 1A:
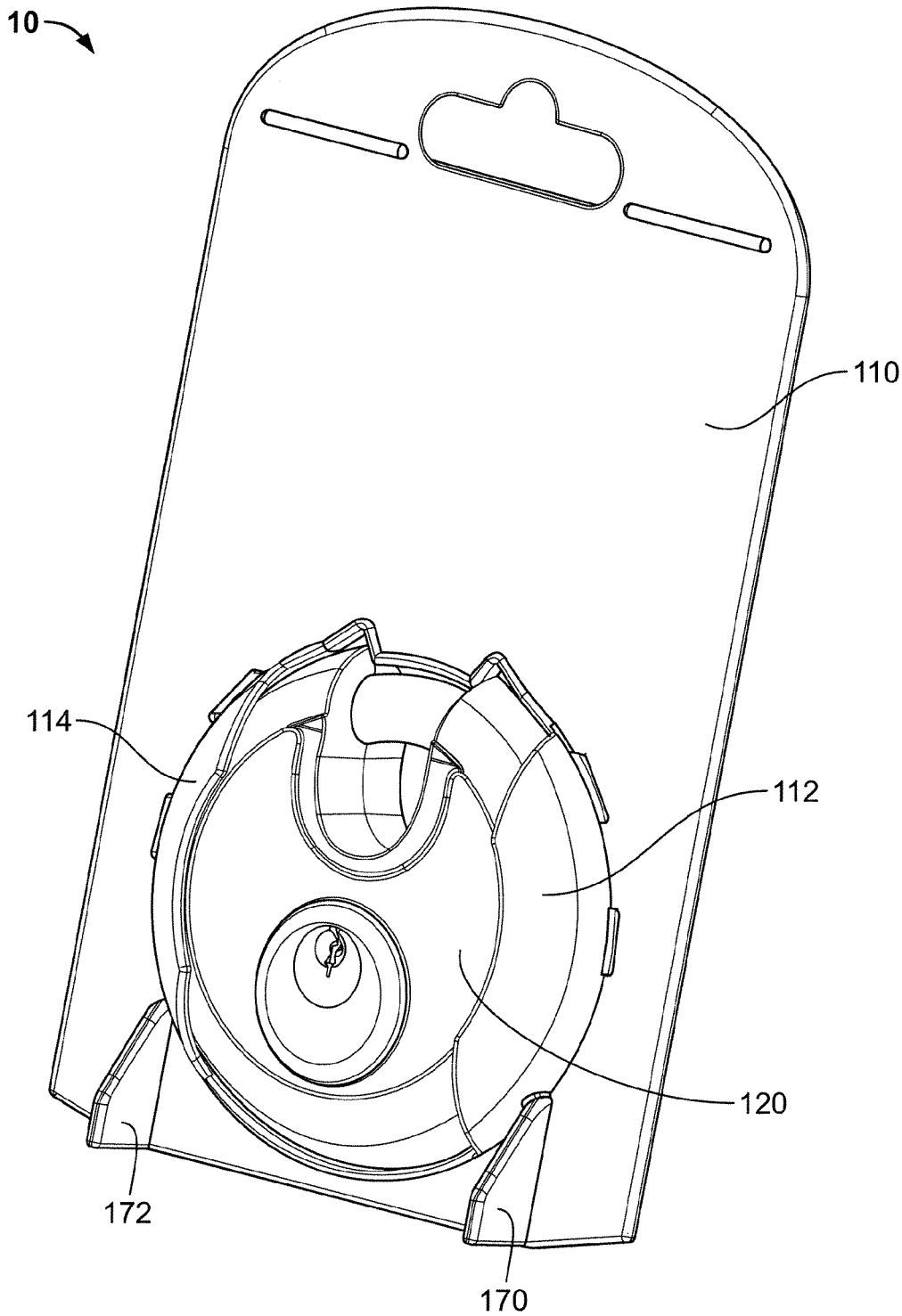
FIGS. 1*a-f* illustrate, in accordance with a first embodiment of the present invention, a system for displaying a padlock, wherein FIG. 1*a* provide a perspective view of the system, FIG. 1*b* provides a rear view of the system, FIG. 1*c* provides a side view of the system, FIG. 1*d* provides a front view of the system, FIG. 1*e* provides a top view of the system and FIG. 1*f* provides a bottom view of the system.
Figure 1B:
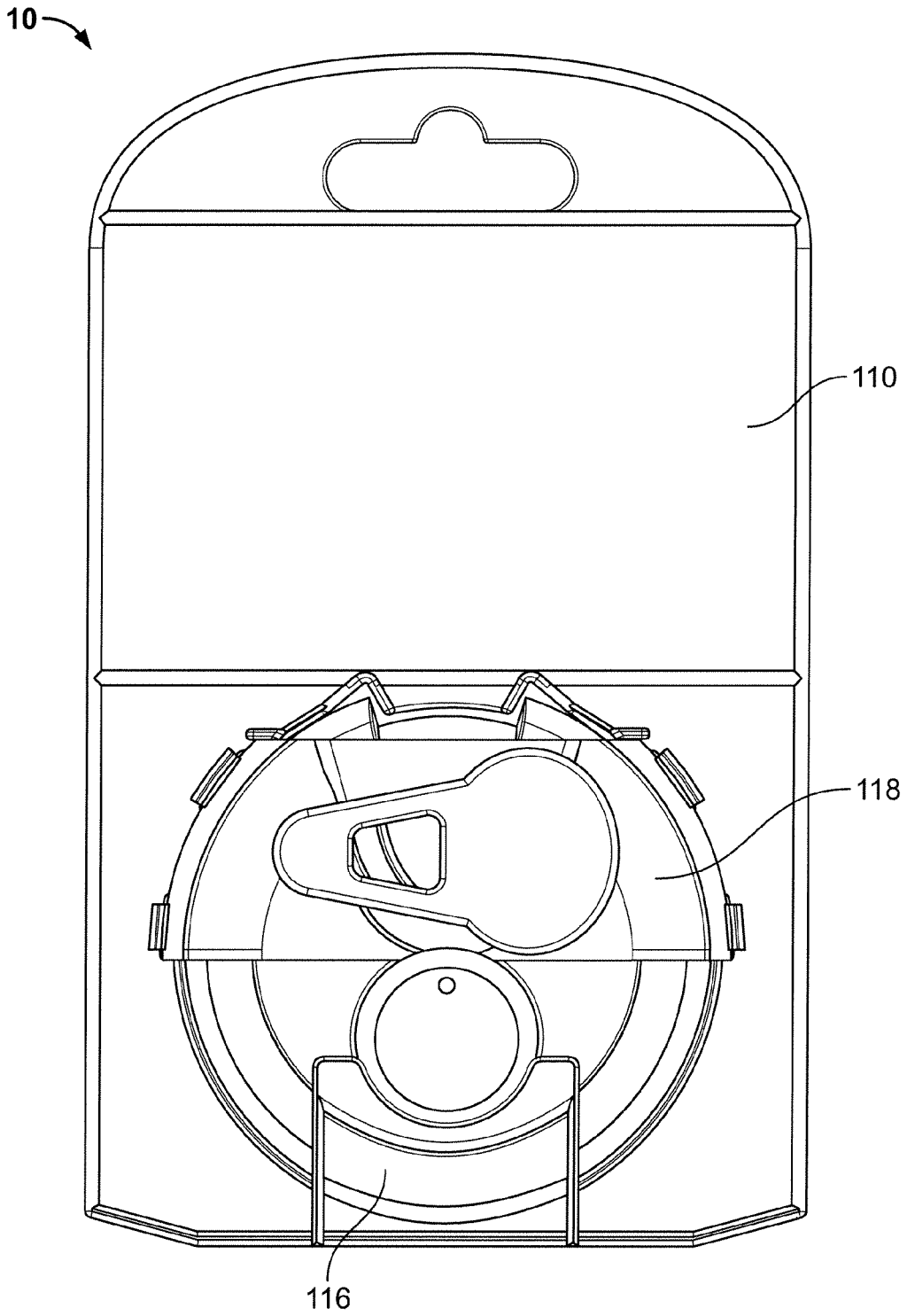
Figure 1C:
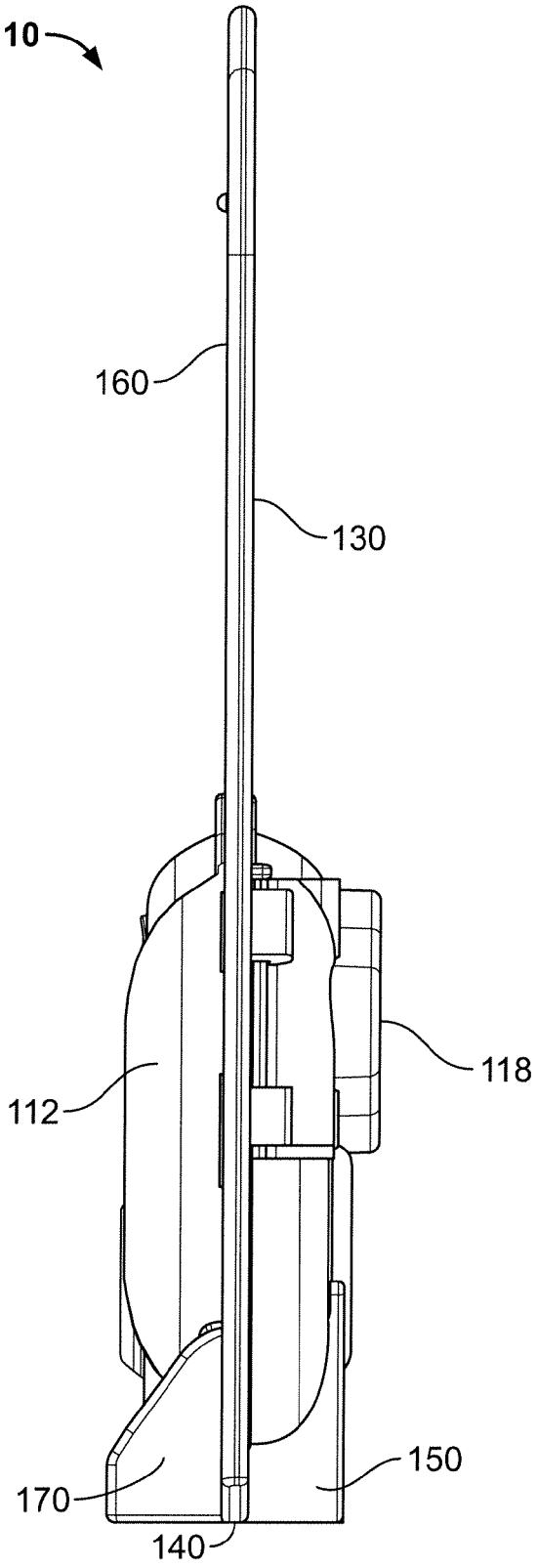
Figure 1D:
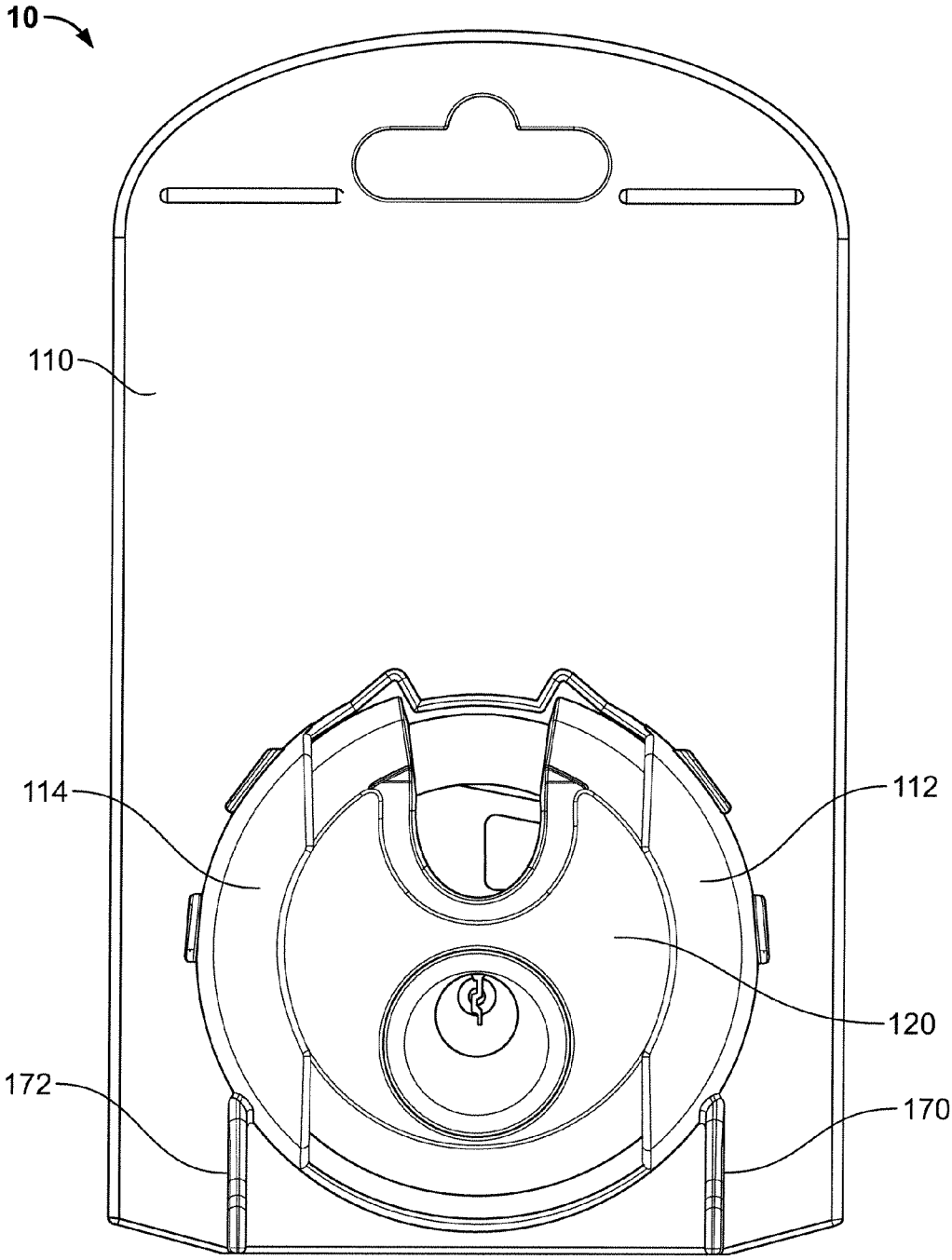
Figure 1E:
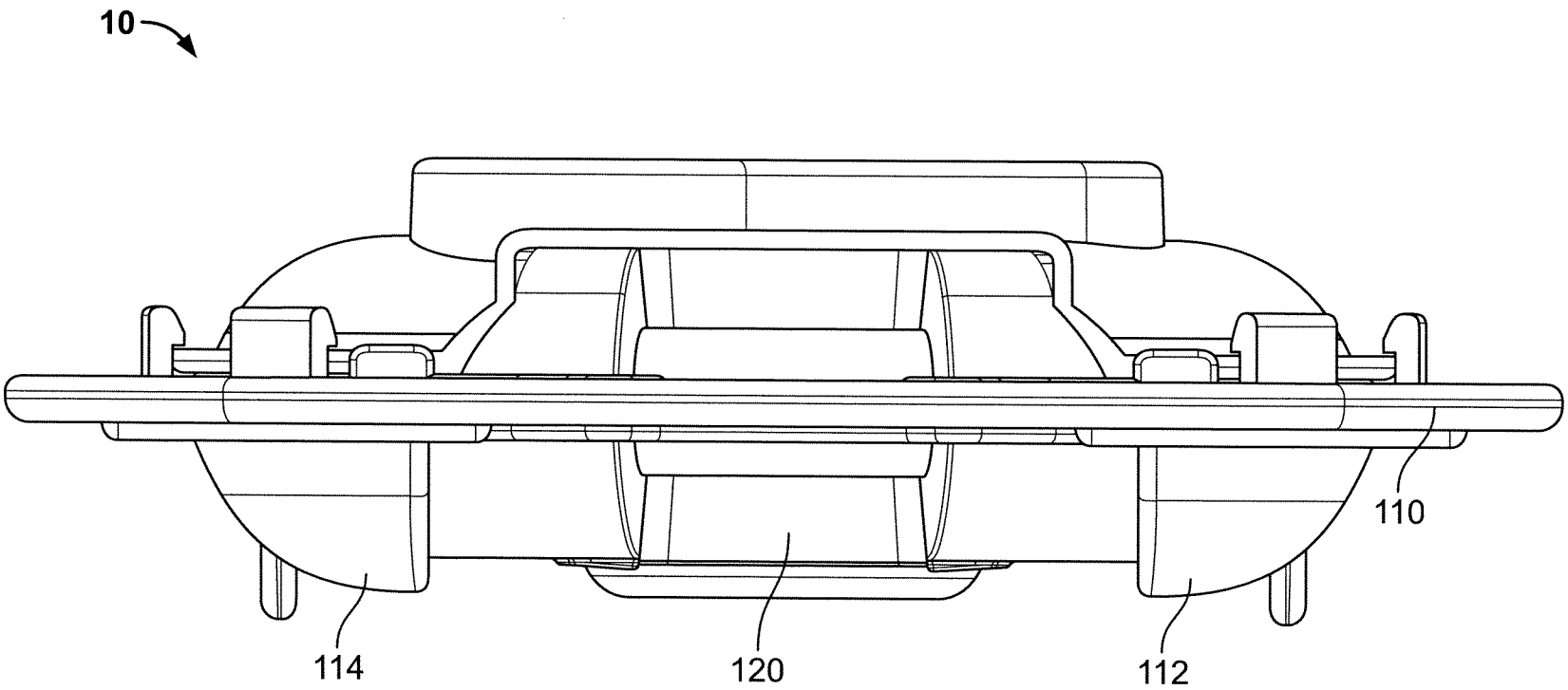
Figure 1F:
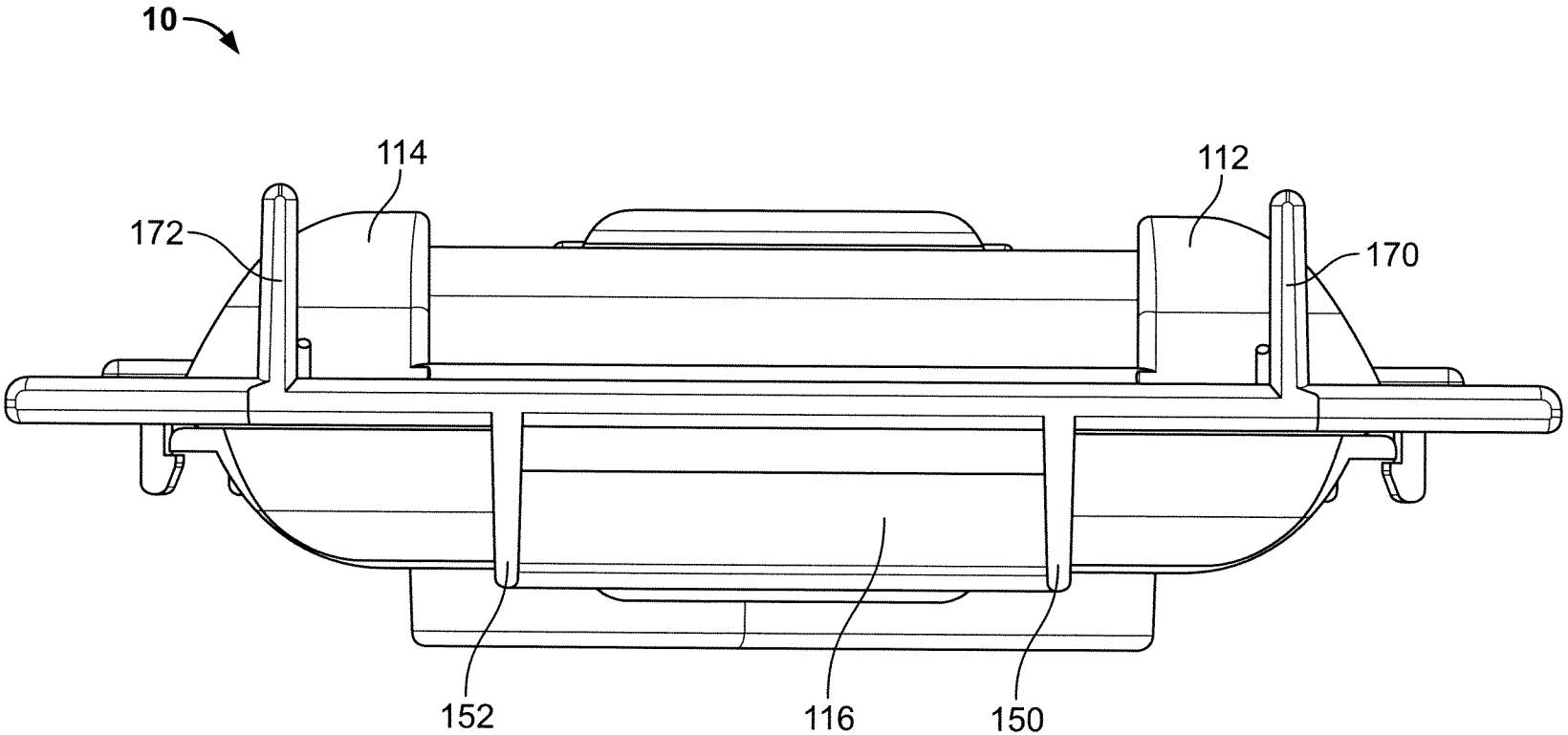
Figure 4:
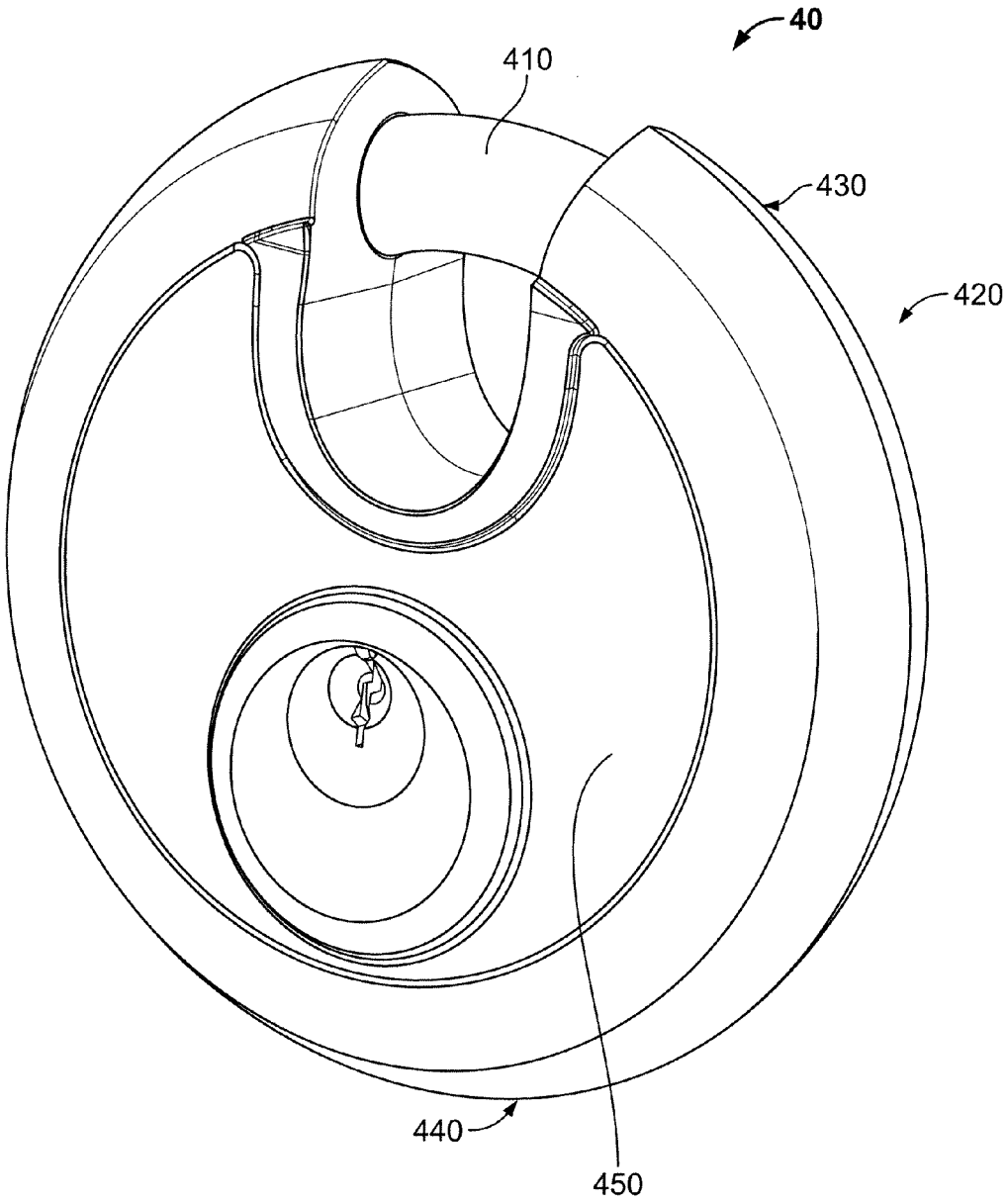
FIG. 4 illustrates, in accordance with at least the first embodiment of the present invention, an exemplary padlock.

FIGS. 1*a-b* show a system for displaying a padlock in accordance with one embodiment of the present invention. The system 10 includes a padlock 120 and a card 110 having a plurality of retaining tabs (e.g., 112, 114 and 116). As shown in FIG. 4, the padlock 40 may include a shackle 410 and a body 420 having a front side 450, a back side 430, and a bottom 440. While the shackle 410 is generally constructed out of metal, the body may be constructed out of metal or a combination of materials (e.g., metal, non-metallic materials, etc.).

Referring back to FIG. 1*a*, the retaining tabs are used to retain the padlock 120 by restricting movement of the padlock 120 in a direction orthogonal and/or parallel to a face (or front side) of the card 110. Each retaining tab is configured to retain (or support) the padlock by providing at least one retaining surface. For example, retaining tab 112 has a first (curved) surface that extends from a face of the card 110 and a second surface that extends from the first surface and is substantially parallel the face of the card 110 (adjacent a front side of the padlock 120), wherein the first surface restricts movement of the padlock 120 in a direction parallel to the face of the card 110 (i.e., prevents the padlock from moving side to side) and the second surface restricts movement of the padlock 120 in a direction orthogonal to the face of the card (i.e., prevents the padlock from moving out, away from the face of the card). Retaining tab 114 is similar to retaining tab 112 in that it includes a first (curved) surface for restricting movement of the padlock 120 in a direction parallel to the face of the card 110 and a second surface for restricting movement of the padlock 120 in a direction orthogonal to the face of the card 110.

It should be appreciated that the present invention is not limited to any particular type of card, and includes all substrates (rigid or flexible, flat or contoured, plastic or cardboard, etc.) generally known to those skilled in the art. It should also be appreciated that the present invention is not limited to any particular type of padlock, and includes all padlocks (keyed or combination, residential or commercial, rectangular or round, etc.) generally known to those skilled in the art. It should further be appreciated that the present invention is not limited to the particular type and number of retaining tabs illustrated in FIGS. 1*a-b*. Thus, for example, a card having additional (or fewer) retaining tabs is within the spirit and scope of the present invention. By way of another example, a system having retaining tabs that are manufactured together with the card (e.g., formed together using injection molding, etc.) or separate from the card (e.g., configured to mate with the card, etc.) is within the spirit and scope of the present invention. It should also be appreciated that while the system shown in FIGS. 1*a-b* only uses retaining tabs to retain a body of the padlock, the present invention is not so limited. For example, a system that includes retaining tabs to retain a body of a padlock, a shackle of a padlock or both a body and a shackle of a padlock, is within the spirit and scope of the present invention.

As shown in FIG. 1*b*, the system 10 further includes a back plate 118 that is configured to mate (or connect) with the card 110 (e.g., via coupling portions; see discussion below), thereby retaining the padlock 120 between at least one retaining tab (e.g., 112 and 114) and the back plate 118. It should be appreciated that the present invention is not limited to any particular type of back plate, and includes all substrates (rigid or flexible, flat or contoured, plastic or cardboard, etc.) generally known to those skilled in the art.

As shown in FIGS. 1*a-f*, the card 110 further includes a front side (or face) 160, a back side 130, a bottom 140, a plurality of front feet 170, 172 that extend from the front side 160 of the card 110 and a plurality of back feet 150, 152 that extend from the back side 130 of the card 110. Preferably, the feet 150, 152, 170 and 172 are substantially tangential to (or aligned with) the bottom 140 of the card 110, thereby allowing the system 10 to be placed on a horizontal shelf (not shown). By configuring the feet 150, 152, 170 and 172 to rest on top of the shelf (or similar structure), the system 10 can be supported in a substantially vertical position.

Figure 2A:
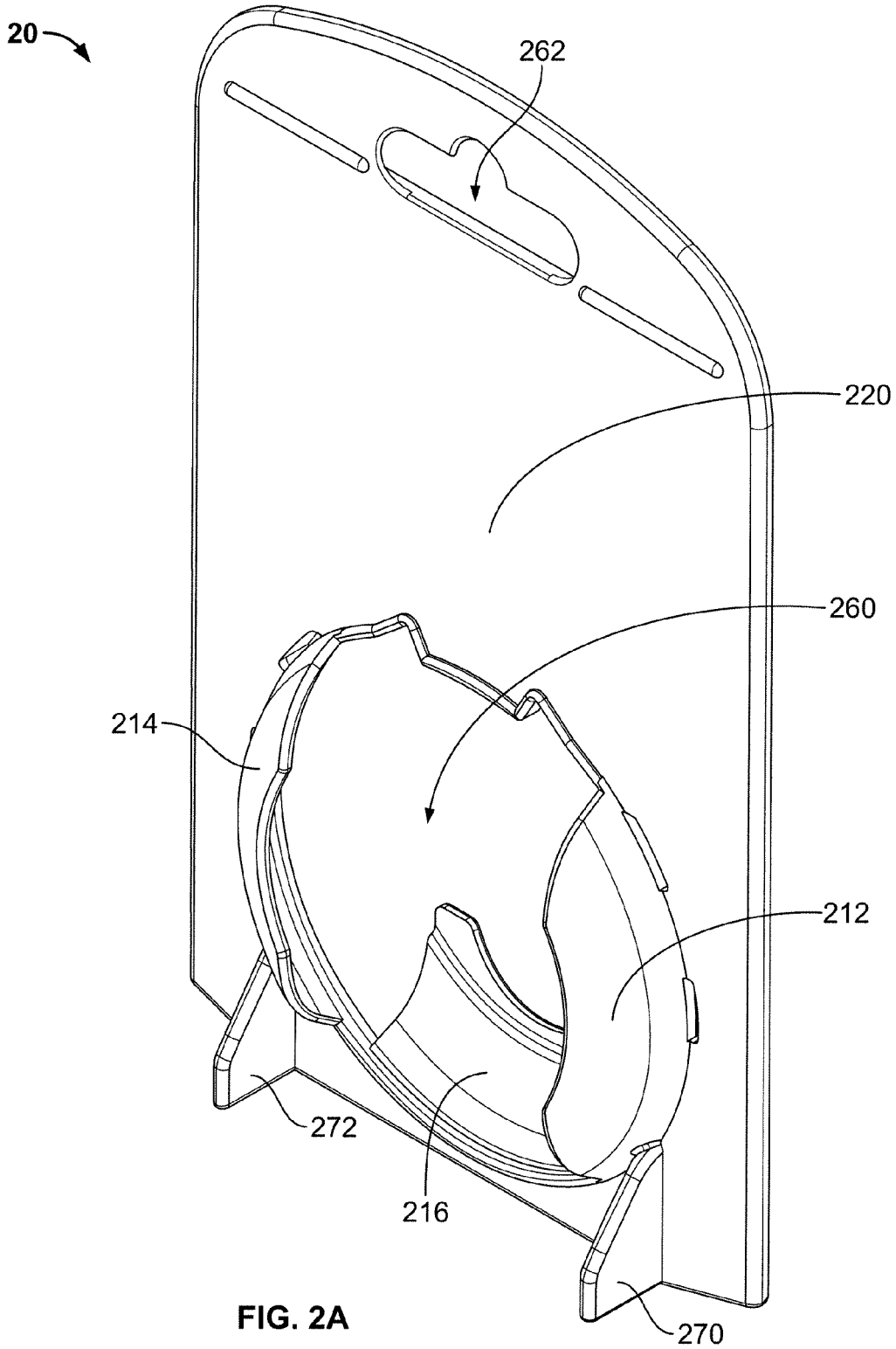
FIGS. 2*a-c* illustrate, in accordance with a second embodiment of the present invention, a card portion of a system for displaying a padlock.

FIGS. 2*a-c* and 3*a-c* show a system for displaying a padlock in accordance with another embodiment of the present invention. Specifically, FIG. 2*a* shows a card 20 having a front side 220 and a plurality of retaining tabs (e.g., 212, 214 and 216). As before, the retaining tabs are used to retain a padlock (not shown) by restricting movement of the padlock in a direction orthogonal and/or parallel to the front side 220 of the card 20. Each retaining tab is configured to retain (or support) the padlock by providing at least one retaining surface. For example, retaining tab 212 has a first (curved) surface that extends from the front side 220 of the card 20 and a second surface that extends from the first surface and is parallel to the front side 220 of the card 20, wherein the first surface restricts movement of the padlock in a direction parallel to the front side 220 of the card 20 (i.e., prevents the padlock from moving side to side) and the second surface restricts movement of the padlock in a direction orthogonal to the front side 220 of the card 20 (i.e., prevents the padlock from moving out, away from the front side of the card). Retaining tab 214 has surfaces that are similar to (but opposite) retaining tab 212. Retaining tab 216 has a first (curved) surface that extends from a back side 230 of the card 20 (see FIG. 2*b*) and a second surface that extends from the first surface and is parallel to the front side 220 of the card 20. Retaining tab 216 is configured to support the bottom of the padlock and restrict movement of the padlock in directions both parallel and orthogonal to the front side 220 of the card 20.

As previously stated, the present invention is not limited to any particular type of card, and includes all substrates (rigid or flexible, flat or contoured, plastic or cardboard, etc.) generally known to those skilled in the art. It should further be appreciated that the present invention is not limited to the particular type and number of retaining tabs illustrated in FIG. 2*a*. Thus, for example, a card having additional (or fewer) retaining tabs and/or different types of retaining tabs (e.g., different shapes, different surfaces, etc.) is within the spirit and scope of the present invention.

As shown in FIG. 2*a*, the card 20 further includes an aperture 260 that is sized to receive at least a body of the padlock (see, e.g., FIG. 4 at 420). In a preferred embodiment of the present invention, the padlock is placed in the aperture 260 by first (i) positioning the padlock behind the card, (ii) placing the shackle of the padlock through the aperture 260 (e.g., from the back side of the card), (iii) moving the shackle upward, toward the front side 220 of the card 20, and (iv) and moving the body of the padlock through the aperture 260 until the body comes into contact with at least one retaining tab (e.g., 212, 214 and 216). Depending on the size of the body of the padlock, a portion of the body may be protruding out a front side of the aperture 260 and a portion of the body may be protruding out a back side of the aperture 260.

Figure 2B:
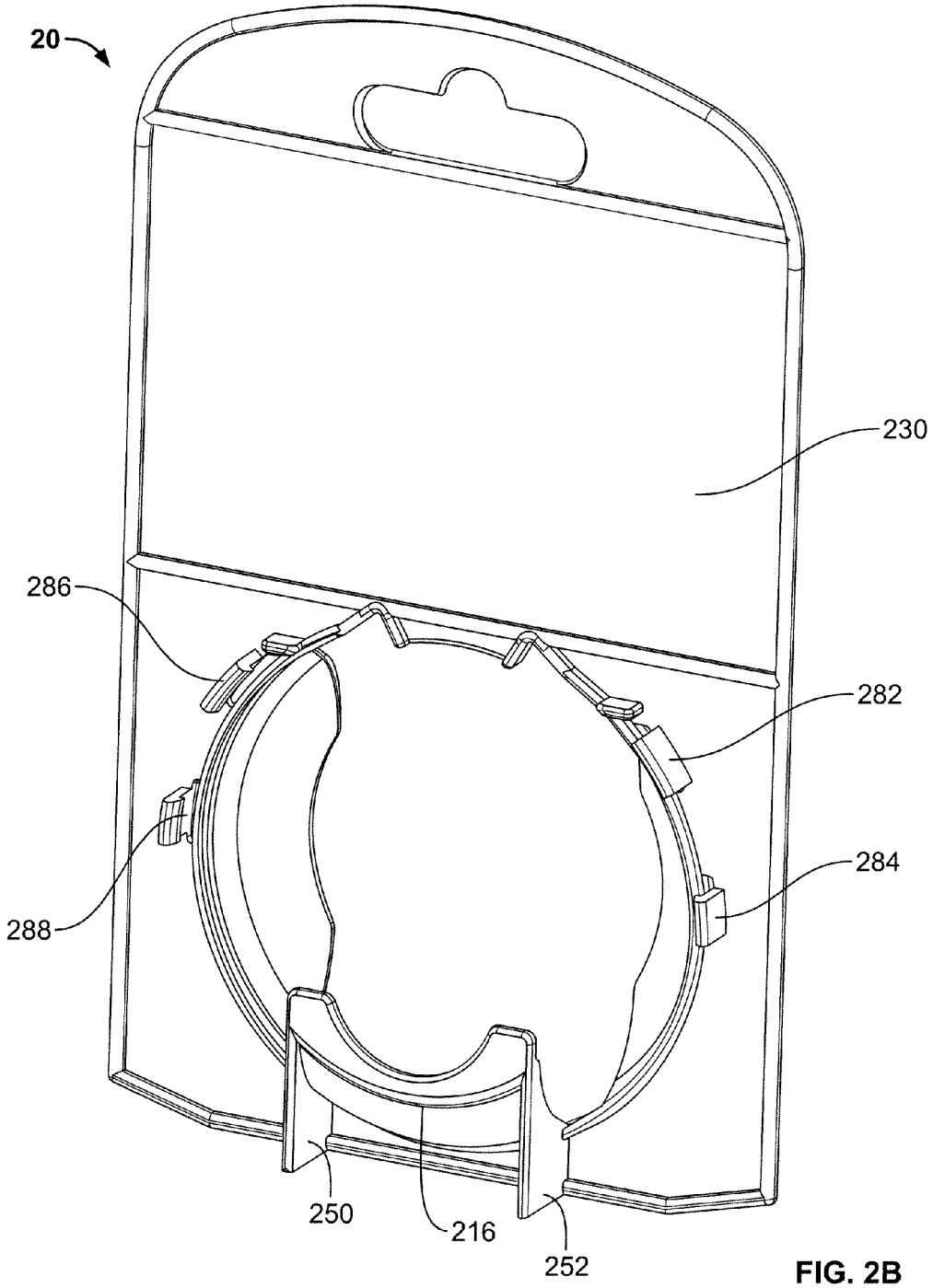
Figure 3A:
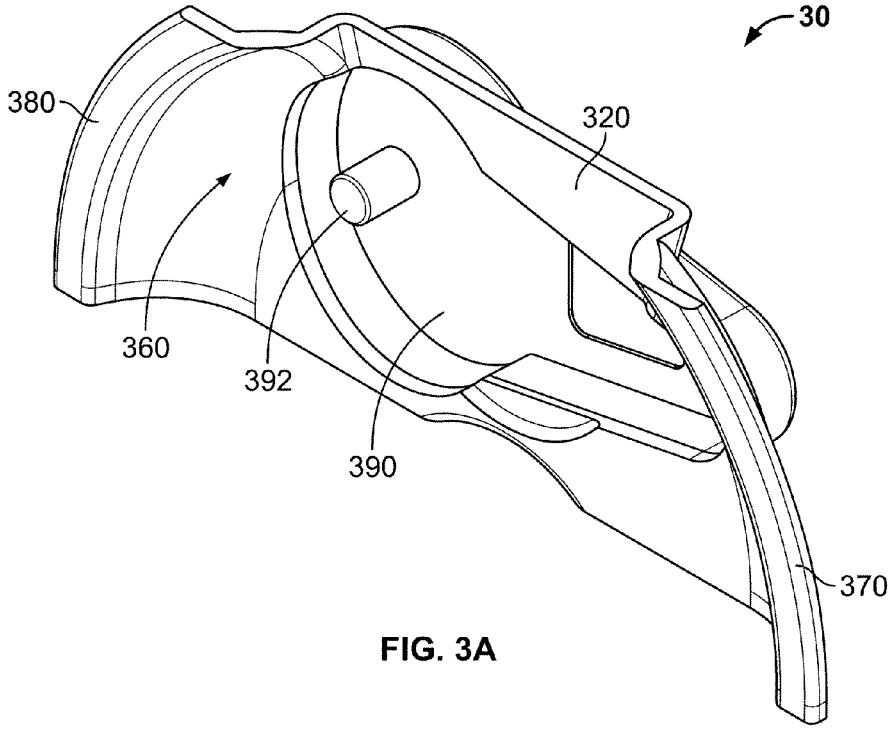
FIGS. 3*a-c* illustrate, in accordance with the second embodiment of the present invention, a back plate portion of a system for displaying a padlock.
Figure 3B:
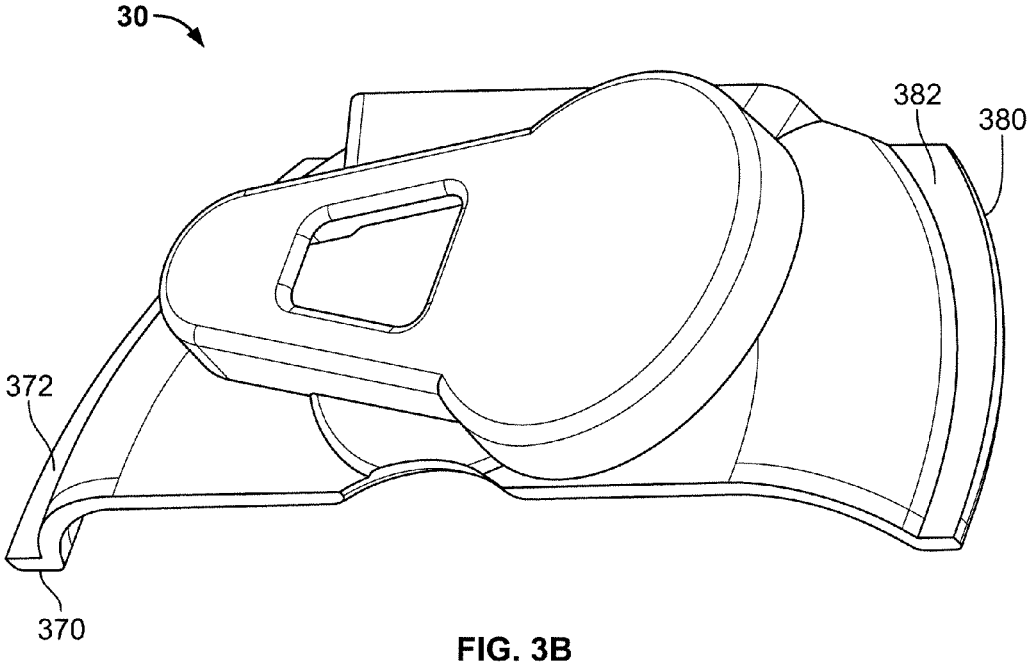
Figure 3C:
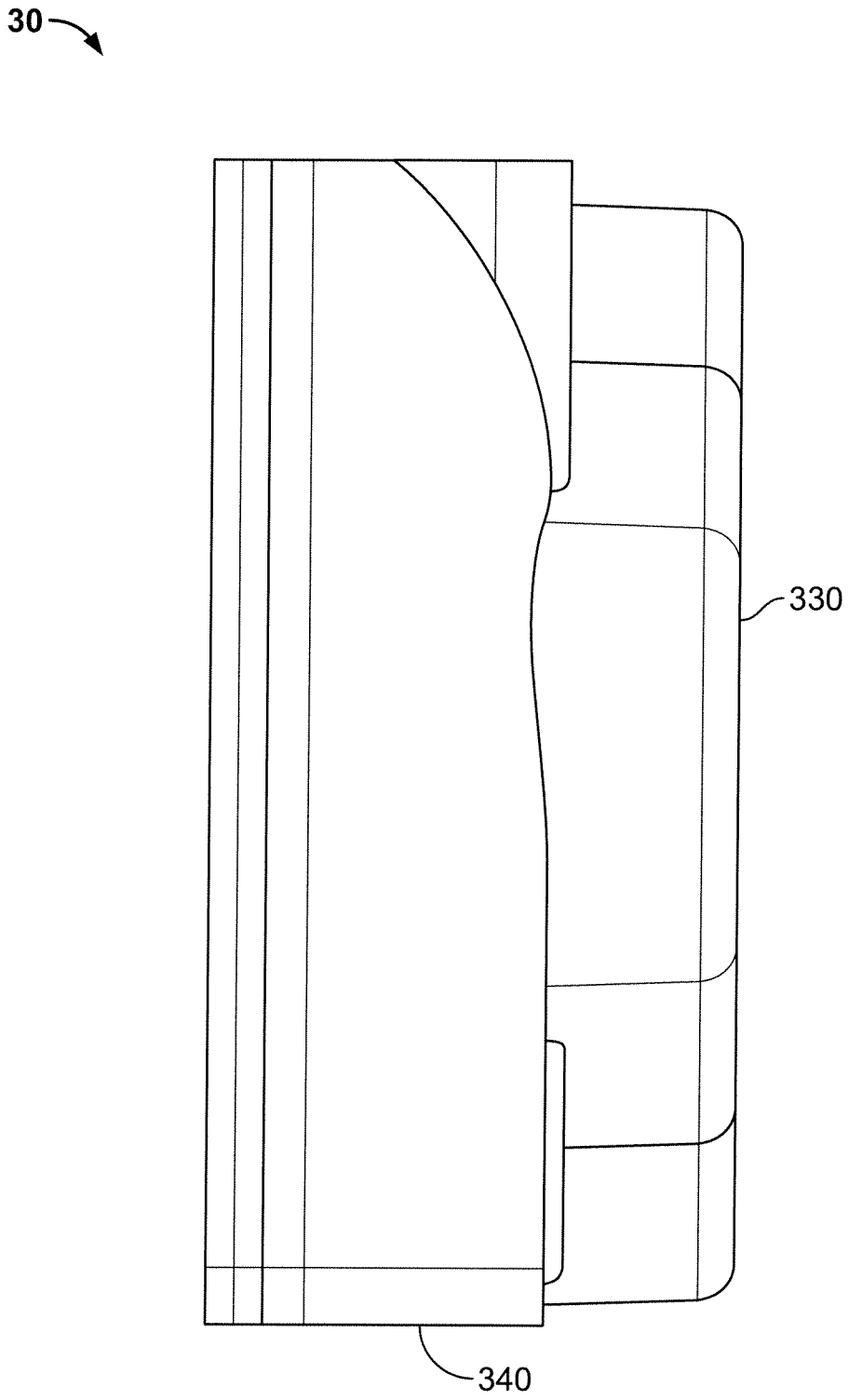

FIGS. 3*a-c* show a back plate 30 that is configured to mate (or connect) with the card 20. Specifically, the back plate 30 includes a back side 330, a bottom 340 and a plurality of coupling portions (e.g., 372 and 382) that are configured to mate with a plurality of coupling portions (e.g., 282, 284, 286 and 288) on the card 20 (see FIG. 2*b*). More particularly, coupling portion 382 is configured to mate with coupling portions 282 and 284, and coupling portion 372 is configured to mate with coupling portions 286 and 288.

In one embodiment of the present invention, the coupling portions on the card (e.g., 282, 284, 286 and 288) are coupling tabs, and the coupling portions on the back plate (e.g., 372 and 382) are coupling ledges. Specifically, as shown in FIGS. 3*a-b*, the back plate 30 includes a first edge 370 having a rear surface comprising a first coupling ledge 372 and a second edge 380 having a rear surface comprising a second coupling ledge 382. In another embodiment of the present invention, each tab (e.g., 282, 284, 286 and 288) includes a protruding head attached to a resilient arm. Once the head is placed over a corresponding ledge, the resiliency of the arm prevents the back plate 30 from being removed from the card 20 until an external force is applied to either the head or the arm.

It should be appreciated that the present invention is not limited to the types of coupling portions shown in FIGS. 2*b* and 3*b*. For example, a card having coupling tabs, coupling ledges, coupling apertures, a combination of coupling tabs, ledges and/or apertures, or any other type of connector (or combination of connectors) generally known to those skilled in the art, is within the spirit and scope of the present invention. By way of example only, a back plate having a hinge on one side (e.g., connected to both the back plate and the card) and at least one coupling portion on the other is within the spirit and scope of the present invention. It should also be appreciated that the present invention is not limited to the number of coupling portions shown in FIGS. 2*b* and 3*b*. For example, a card having additional (or fewer) coupling portions is within the spirit and scope of the present invention.

Referring back to FIG. 3*a*, the back plate 30 further includes a front side 320 and at least one retaining surface (e.g., 360). Like the retaining tabs, the retaining surface is used to retain the padlock by restricting movement of the padlock in a direction parallel and orthogonal to the front side 220 of the card 20. In contradistinction, the front side 320 of the back plate 30 is used to retain the padlock by restricting movement of the padlock in a direction orthogonal to the front side 220 of the card 20.

As shown in FIG. 3*a*, the back plate 30 may further include a recess 390, preferably shaped to receive at least one key, and/or a post 392 configured to fit inside an aperture of at least one key. By moving the padlock into the aperture 260 of the card 20, placing the key(s) into the recess 390 and/or over the post 392 of the back plate 30, and mating the back plate 30 to the card 20, both the padlock and the key(s) can be retained (or secured). In a preferred embodiment of the present invention, the padlock is retained between at least one retaining tab (e.g., 212, 214 and 216) and the front side 320 of the back plate 30, and the key(s) is retained between the back side of the padlock and the front side 320 (or recess 390) of the back plate 30.

Figure 2C:
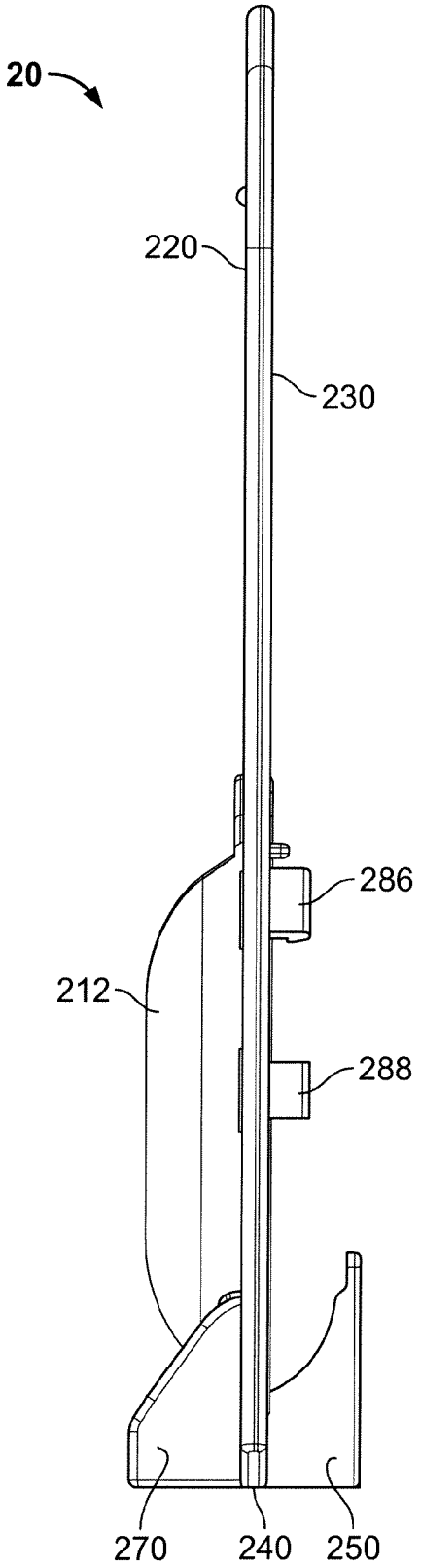

As shown in FIGS. 2*a-c*, the card 20 further includes a plurality of front feet 270, 272 and a plurality of rear feet 250, 252, thereby allowing the card 20 to be placed on a horizontal shelf (not shown). Preferably, the front feet extend from the front side 220 of the card 20, are orthogonal to the front side 220 of the card 20, and are substantially tangential to (or aligned with) the bottom 240 of the card 20, and the rear feet extend from the rear side 230 of the card, are orthogonal to the rear side 230 of the card 20, and are substantially tangential to (or aligned with) the bottom 240 of the card 20. By configuring the feet 250, 252, 270 and 272 to rest on top of the shelf (or similar structure), the card 20 can be supported in a substantially vertical position.

In another embodiment of the present invention, as shown in FIG. 2*a*, the card 20 further includes a second aperture 262 configured to mate with a hook (not shown) (e.g., as found on a display rack). By placing the aperture 262 over the hook, the card 20 can be supported in a substantially vertical position.

It should be appreciated that while the foregoing embodiments are directed toward packages for retaining a single padlock, the present invention is not so limited. For example, a system that includes a card, a back plate and at least two padlocks is within the spirit and scope of the present invention.

Figure 5:
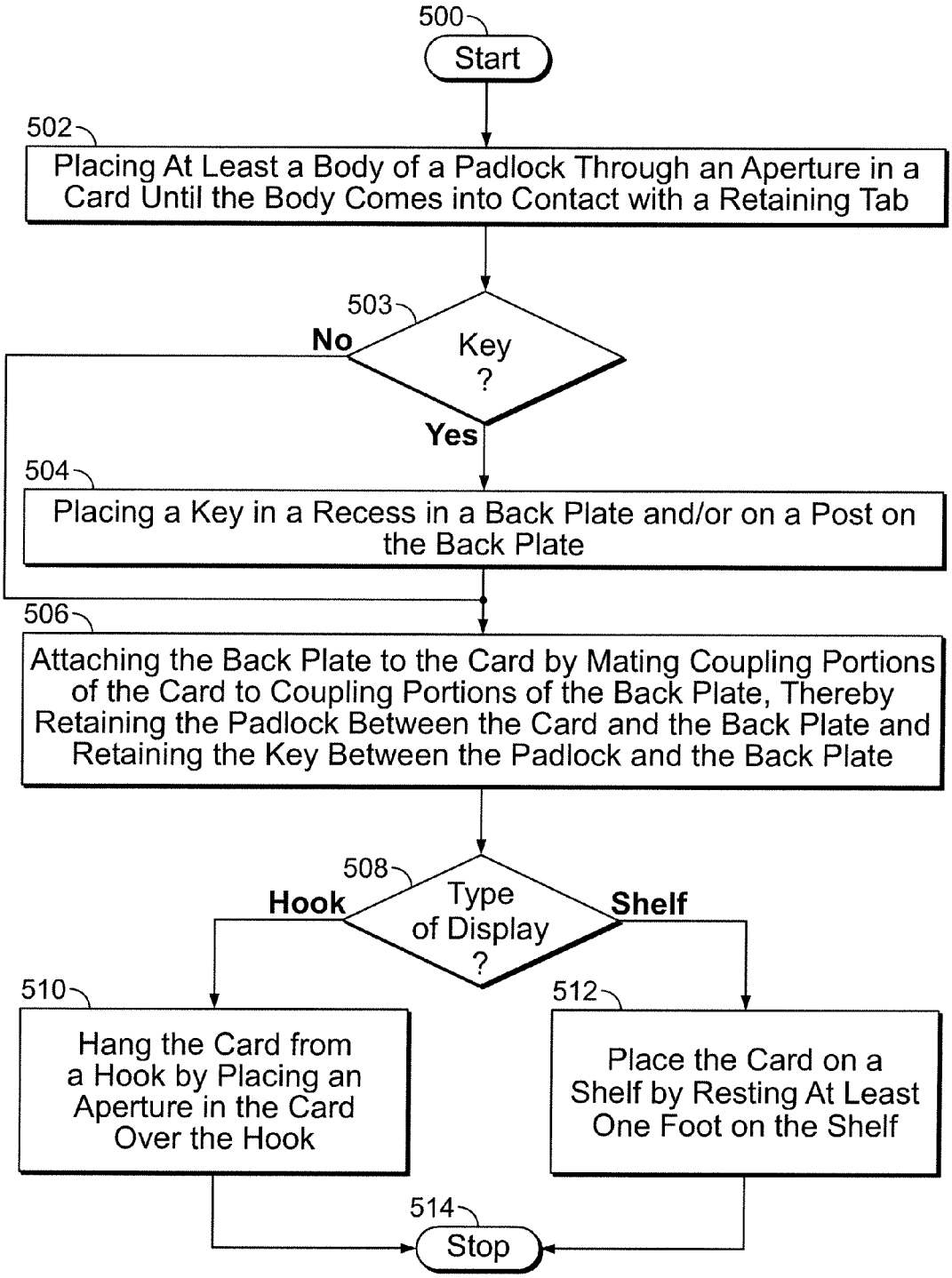
FIG. 5 provides, in accordance with one embodiment of the present invention, a method for displaying a padlock.

FIG. 5 provides a method of displaying a padlock in accordance with one embodiment of the present invention. Starting at step 500, at least a body of the padlock is placed through an aperture in a card at step 502, preferably until the body comes into contact with at least one retaining tab. In a preferred embodiment of the present invention, the shackle of the padlock is placed through the aperture (from a back side of the card) and rotated upward (toward a front side of the card), allowing the body of the padlock to be placed inside the aperture of the card. At step 503, if the padlock includes at least one key, then, at step 504, the key(s) is placed inside a recess in a back plate and/or over a post on the back plate. At step 506, the back plate is then attached to the card by mating at least one coupling portion of the card (e.g., a coupling tab) with at least one coupling portion of the back plate (e.g., a coupling ledge). This results in the padlock body being retained between the card (e.g., at least one retaining tab) and the back plate. It also results in the key(s) being retained between the padlock body and the back plate (e.g., a front side of the back plate, a recess in the back plate, etc.). The package can then be placed on either a hook or a shelf at step 508. If the package is to be placed on a hook, then an aperture in the card is placed over the hook at step 510. If, however, the package is to be placed on a shelf, then at least one foot is placed on top of the shelf at step 512, ending the method at step 514. By hanging the card from a hook or placing the card on a shelf (or similar horizontal structure, e.g., horizontal display rack, etc.), the card can be supported in a substantially vertical position.

Having thus described several embodiments of a system and method for displaying a padlock, it should be apparent to those skilled in the art that certain advantages of the system and method have been achieved. For example, by limiting the size and/or number of retaining tabs, the consumer can freely touch portions of the padlock (e.g., portions of the body, the shackle, etc.) without having to remove the padlock from its package. It should also be appreciated that various modifications, adaptations, and alternative embodiments thereof may be made within the scope and spirit of the present invention. The invention is solely defined by the following claims.

What is claimed is:

1. A system for displaying a padlock, comprising:

a padlock having a body and a shackle;

a card having at least a front side, a back side, a bottom, an aperture, a retaining tab and a coupling portion, wherein the retaining tab includes at least a first portion that extends from the front side of the card and a second portion that extends from the first portion and is substantially parallel to the front side of the card; and a back plate comprising at least a front side, a back side, a bottom and at least one coupling portion;

wherein the aperture is sized to receive at least the body of the padlock, and the coupling portion of the card is configured to mate with the coupling portion of the back plate, thereby retaining the padlock between the retaining tab of the card and the front side of the back plate, the second portion of the retaining tab being configured to restricting movement of at least the body of the padlock in a direction orthogonal to the front side of the card, and the first portion of the retaining tab being configured to restrict movement of at least the body of the padlock in a direction parallel to the front side of the card.

2. The system of claim 1, wherein the card comprises a plurality of retaining tabs, each one of the plurality of retaining tabs includes at least a first portion that extends from the front side of the card and a second portion that extends from the first portion and is substantially parallel to the front side of the card, the first portions of the plurality of retaining tabs being configured to restrict movement of at least the body of the padlock in a direction parallel to the front side of the card, and the second portions of the plurality of retaining tabs being configured to restrict movement of at least the body of the padlock in a direction orthogonal to the front side of the card.

3. The system of claim 1, wherein the card further comprises a second retaining tab having at least a first portion that extends from the back side of the card and is configured to restrict movement of the padlock in a direction parallel to the front side of the card.

4. The system of claim 3, wherein the second retaining tab further comprises a second portion that extends from the first portion of the second retaining tab and is configured to restrict movement of the padlock in a direction orthogonal to the front side of the card.

5. The system of claim 1, wherein the card further comprises a second aperture configured to mate with a hook, allowing the card to be hung from the hook.

6. The system of claim 1, wherein the card further comprises at least one foot that extends from and is substantially orthogonal to the front side of the card and is configured to support the card on a shelf in a substantially vertical position.

7. The system of claim 1, wherein the card further comprises at least one foot that extends from and is substantially orthogonal to the back side of the card and is configured to support the card on a shelf in a substantially vertical position.

8. The system of claim 6, wherein the card further comprises at least one additional foot that extends from and is substantially orthogonal to the back side of the card and is configured to support the card on a shelf in a substantially vertical position.

9. The system of claim 1, wherein the coupling portion of the card is a coupling tab and the coupling portion of the back plate is a coupling ledge, the coupling tab being configured to mate with the coupling ledge.

10. The system of claim 1, wherein the back plate further comprises at least one retaining surface that extends from the front side of the back plate and is configured to restrict movement of the padlock in a direction parallel to the front side of the card.

11. The system of claim 1, wherein the back plate further comprises a recess configured to receive at least one key corresponding to the padlock, the at least one key being retained between the body of the padlock and the recess.

12. The system of claim 1, wherein the back plate further comprises a post configured to mate with at least one aperture in at least one key corresponding to the padlock, the at least one key being retained between the body of the padlock and a front side of the back plate.

13. The system of claim 11, wherein the recess further comprises a post configured to mate with at least one aperture in the at least one key.

* * * * *